US005239706A

United States Patent [19]

Stevenson

[11] Patent Number: 5,239,706

[45] Date of Patent: Aug. 31, 1993

[54] UNDERPANTS AND COORDINATED BIFURCATED OVERGARMENT

[76] Inventor: Jane M. Stevenson, P.O. Box 422, Norwich, Vt. 05055

[21] Appl. No.: 731,210

[22] Filed: Jul. 15, 1991

[51] Int. Cl.[5] ..... A41D 13/10

[52] U.S. Cl. ..... 2/408; 2/400; 2/403; 2/406; 604/395; 604/396; 450/102

[58] Field of Search ..... 2/67, 70, 71, 72, 73, 2/75, 79, 80, 400, 401, 402, 403, 406, 408, 409, 227; 128/158; 604/395, 396, 385.2; 450/102, 103, 104, 105

[56] References Cited

U.S. PATENT DOCUMENTS

| | | | |
|---|---|---|---|
| Re. 23,845 | 7/1954 | Siegel et al. . | |
| 584,490 | 6/1897 | Warren . | |
| 623,658 | 4/1899 | Everson | 604/395 |
| 1,112,162 | 9/1914 | Rovira . | |
| 1,168,023 | 1/1916 | Morley | 2/78 B |
| 1,297,481 | 3/1919 | Lebontz | 604/395 |
| 1,431,315 | 10/1922 | Le Moine . | |
| 1,568,449 | 1/1926 | Gardner . | |
| 1,580,464 | 4/1926 | Blumenfeld . | |
| 1,692,350 | 11/1928 | Robertson | 2/408 |
| 1,964,447 | 6/1934 | Beckerman | 2/71 |
| 2,027,622 | 1/1936 | Stam | 2/403 X |
| 2,028,235 | 1/1936 | Olver | 604/395 |
| 2,058,970 | 10/1936 | Flesh | 2/403 |
| 2,381,232 | 8/1945 | Stone . | |
| 2,391,770 | 12/1945 | Cangelosé | 2/71 |
| 2,396,599 | 3/1946 | O'Brien | 2/408 |
| 2,483,302 | 9/1949 | Rockwell | 2/401 X |
| 2,503,636 | 4/1950 | Rockwell | 450/103 |
| 2,530,647 | 11/1950 | Buchler . | |
| 2,573,903 | 11/1951 | Gordon | 2/402 |
| 2,574,132 | 11/1951 | Sutter | 450/103 |
| 2,597,587 | 5/1952 | Lustgarten | 1/1 |
| 2,652,057 | 9/1953 | Siegel . | |
| 2,779,333 | 1/1957 | Gordon | 2/402 |
| 2,896,633 | 7/1959 | McKee . | |
| 3,037,503 | 6/1962 | Ravaschieri | 2/403 X |
| 3,154,082 | 10/1964 | Cape | 2/408 |
| 3,279,469 | 10/1966 | Schustack | 2/408 X |
| 3,823,721 | 7/1974 | Herbener . | |
| 3,974,836 | 8/1976 | Carlson | 2/408 X |
| 4,446,575 | 5/1984 | Davis | 2/408 X |
| 4,578,828 | 8/1986 | Smith, Sr. et al. | 2/408 |
| 4,597,110 | 7/1986 | Smith, Sr. et al. . | |
| 4,637,078 | 1/1987 | Southwell | 2/408 |
| 4,802,469 | 2/1989 | Gollestoni | 2/408 |
| 4,835,795 | 6/1989 | Lonon . | |
| 4,875,236 | 10/1989 | Boynton | 2/403 X |
| 4,883,481 | 11/1989 | Blanchard | 2/402 X |
| 4,951,321 | 8/1990 | Mortensen et al. | 2/408 |
| 5,123,120 | 6/1992 | Ross | 2/79 X |

FOREIGN PATENT DOCUMENTS

| | | | |
|---|---|---|---|
| 961632 | 11/1933 | Australia | 128/158 |
| 0507332 | 4/1953 | Belgium | 604/395 |
| 461986 | 12/1949 | Canada | 128/158 |
| 461896 | 1/1914 | France | 2/227 |
| 0497591 | 12/1938 | United Kingdom | 450/103 |
| 0664301 | 1/1952 | United Kingdom | 450/103 |

*Primary Examiner*—Clifford D. Crowder
*Assistant Examiner*—Jeanette E. Chapman
*Attorney, Agent, or Firm*—Michael J. Weins

[57] ABSTRACT

The present invention is for an undergarment which can be used separately or in combination with a bifurcated overgarment. Both the undergarment and the bifurcated overgarment are designed with crotch elements which can be easily opened and closed, allowing body waste elimination without requiring partial disrobing. The undergarment has a slidable crotch panel which moves between a closed position and an open position. The overgarment has a closeable crotch opening which, when worn with the undergarment of the present invention, is aligned with the slidable crotch panel of the undergarment. The overgarment preferably has side openings which allow access to the undergarment so that the undergarment can be adjusted.

28 Claims, 6 Drawing Sheets

FIG-1
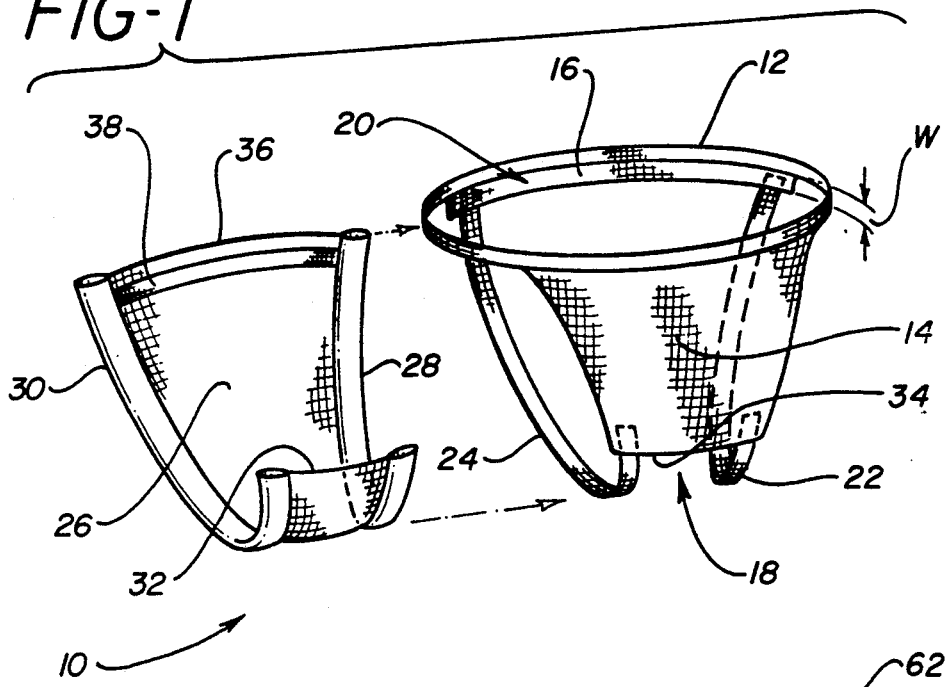
FIG-2
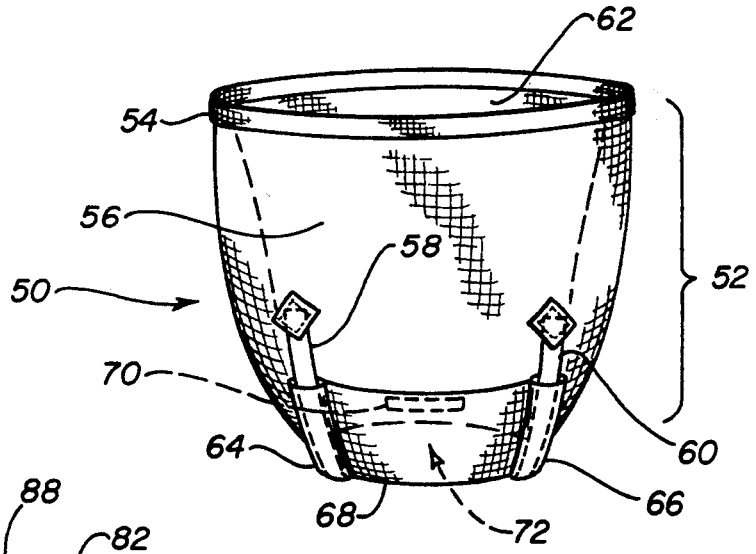
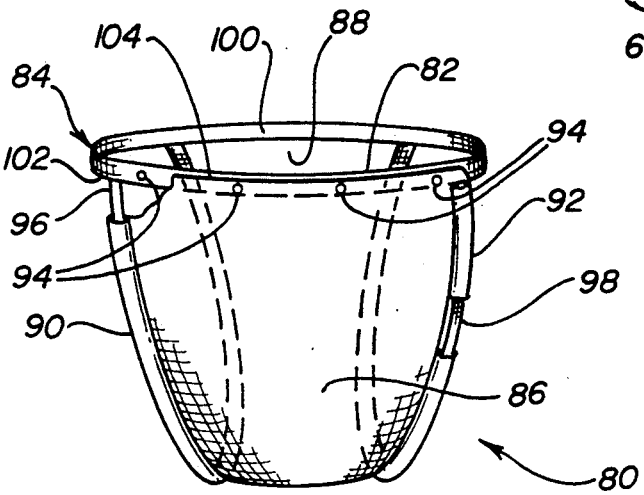
FIG-3

UNDERPANTS AND COORDINATED BIFURCATED OVERGARMENT

FIELD OF THE INVENTION

The present invention relates to an undergarment which can be used separately or in combination with a bifurcated overgarment such as slacks, where both the undergarment and the bifurcated overgarment are provided with an easily opened and closed crotch element allowing body waste elimination without partial disrobing.

BACKGROUND OF THE INVENTION

Crotch opening garments for men including both undergarments and bifurcated overgarments such as slacks which facilitate urination without disrobing have been long available. These garments allow the waist band to remain fastened so the shirt and belt, etc. may be left in place and thus are garments of convenience. However, there have been no similar convenience garments for women. When wearing pants or other legged garments, classically women have had to undo the waist band, belt, etc. and partially disrobe which can be both a time consuming process and a disconcerting procedure wherein private parts of the body must be exposed. The disrobing process may cause the garments to drag on the floor or ground where they may become soiled or wet. In outdoor activities such as hiking and camping, disrobing can also be undesirable because of the lack of privacy, since there are often no toilet facilities. Also in outdoor situations when the weather is adverse it can be undesirable to disrobe, exposing one's body to the elements.

The problem of disrobing has been addressed in part by U.S. Pat. No. 4,597,110 and U.S. Pat. No. 4,835,795, which relate to openable undergarments. These undergarments have front opening flaps which must be fastened or otherwise maintained out of the way. If these undergarments are used in combination with a bifurcated overgarment it may require pulling the flap through an opening in the overgarment, then repositioning the flap under the overgarment and refastening the flap to the undergarment. This is a process requiring several motions and is time consuming. The problem of a flap has been overcome in part for undergarments by the flapless undergarment disclosed in U.S. Pat. No. 3,823,721, however the undergarment does not have means for securing the garment in a closed position. Furthermore, none of the above described garments provide a bifurcated overgarment which can be used in combination with undergarments.

Thus, there is a need for convenience garments designed for women which allow the wearer to eliminate body waste without disrobing.

SUMMARY OF THE INVENTION

It is an object of the present invention to provide a flapless undergarment for women which has a readily openable and closable crotch.

It is another object of the present invention to provide an openable undergarment for women which does not require disrobing to eliminate body waste.

It is another object of the present invention to provide an undergarment for women which, when opened, remains in the open position.

It is still another object of the invention to provide a bifurcated overgarment for women which has an openable crotch.

It is another object of the present invention to provide a bifurcated overgarment with an openable crotch, for women, which when opened can readily be maintained in the open position.

Yet another object of the present invention is to provide a bifurcated overgarment for women having a crotch opening which can be closed and when closed is substantially hidden.

Still a further object of the present invention is to provide an openable undergarment and an openable bifurcated overgarment which are designed to be used in combination to allow elimination of body waste without disrobing.

These and other objects of the present invention will become apparent from the following figures, descriptions, and claims.

The present invention relates to an undergarment and a bifurcated overgarment. In its simplest form the undergarment of the present invention has a waist band which encircles the waist or hips of the wearer. A front panel and a rear panel are attached to the waist band providing a crotch opening between the front panel and the rear panel. The rear panel and the waist band form a back region. The front panel and the back region have attached thereto a left strap and a right strap which are spaced apart and span the crotch opening.

A crotch panel for covering the crotch opening is provided. The crotch panel has a left casing and a right casing. The left casing slidably engages the left strap and the right casing slidably engages the right strap. It is further preferred that the straps are flat and that the casings have a width which is only slightly greater than the width of the straps. Having the casing width so sized will help prevent the straps from twisting.

The crotch panel is attached to the front panel. When the casings are slidably engaged with the straps, such that the casings substantially cover the straps, the crotch panel covers the crotch opening in the undergarment. When the crotch panel casings are slidably engaged over the length of the straps, the crotch panel provides a closed crotch which the wearer can open by grasping the crotch panel and pulling it forward towards the front panel. As the panel moves forward the crotch panel casings slide along the straps and the crotch panel gathers into folds. The straps aid in holding the gathered crotch panel in position and out of the way, maintaining the crotch panel in an open position.

Preferably the left strap and the right strap are made of an elastic material. The elasticity of the straps helps maintain the crotch panel in close proximity to the body. It is further preferred that the crotch panel is fabricated from stretchable material, and that the material is a two way stretchable material such as Lycra® spandex. Such material in combination with the elastic straps helps maintain the crotch panel in close proximity to the body when the panel is in the closed position.

When the front panel has a left edge and a right edge, and the rear panel has a left edge and a right edge and these edges do not meet, the above described undergarment is what is frequently referred to as a pair of bikini style underpants. The pair of bikini style underpants provides an open space running from the crotch to the waist band, which provides an opening for the leg and the thigh.

When a pair of brief style underpants is desired the left edge of the front panel and the left edge of the rear panel join to form a left side of the undergarment, while the right edge of the front panel and the right edge of the rear panel join to form a right side of the undergarment. The left side has a left cutout section and the right side has a right cutout section. The left cutout section and the right cutout section are bound by leg bands. Preferably the leg bands are elastic. It is further preferred that the left strap and the right strap attach to the front panel and to the leg bands.

The bifurcated overgarment of the present invention which is designed to be used with the undergarment of the present invention, in its simplest form has a trunk element, a left leg element, and a right leg element. The trunk element covers the lower portion of the torso of the wearer. The trunk element has a front side and a back side with a center seam passing from the front to the back. The trunk element attaches to the left leg element and to the right leg element with the junction of these three elements forming a crotch.

A closable elongated opening is centered with respect to the crotch and lies in the center seam. The closable elongated opening is preferably at least about 14 inches long. Preferably the means for closing the closable elongated opening is a soft zipper and the zipper is positioned so that the tab is located at the front of the garment when the zipper is in the closed position. So orienting the zipper ensures that the zipper tab will not cause discomfort to the wearer when seated.

It is further preferred that a pair of openings be provided so that the hands can readily be placed under the overgarment to assist in the positioning of the undergarment crotch panel. The pair of openings is particularly helpful for one piece outfits such as ski suits and for belted overgarments.

In one preferred embodiment the openings are located at the sides of the overgarment. In another preferred embodiment the openings are located in the back side of the trunk element.

BRIEF DESCRIPTION OF THE FIGURES

FIG. 1 is an exploded view of one embodiment of the present invention where the undergarment is a pair of bikini style underpants.

FIG. 2 is a rear view of another embodiment of the present invention where the undergarment is a pair of bikini style underpants. In this embodiment a crotch panel is attached to a rear panel of the pair of bikini style underpants with a hook and pile fastener.

FIG. 3 is another embodiment of a bikini style undergarment of the present invention. In this embodiment straps for guiding a crotch panel attach directly to the waist band, and the front panel and the crotch panel form an integral unit.

In FIG. 6 the crotch casings fully engage the straps.

BEST MODE FOR CARRYING THE INVENTION INTO PRACTICE

Figure 4:
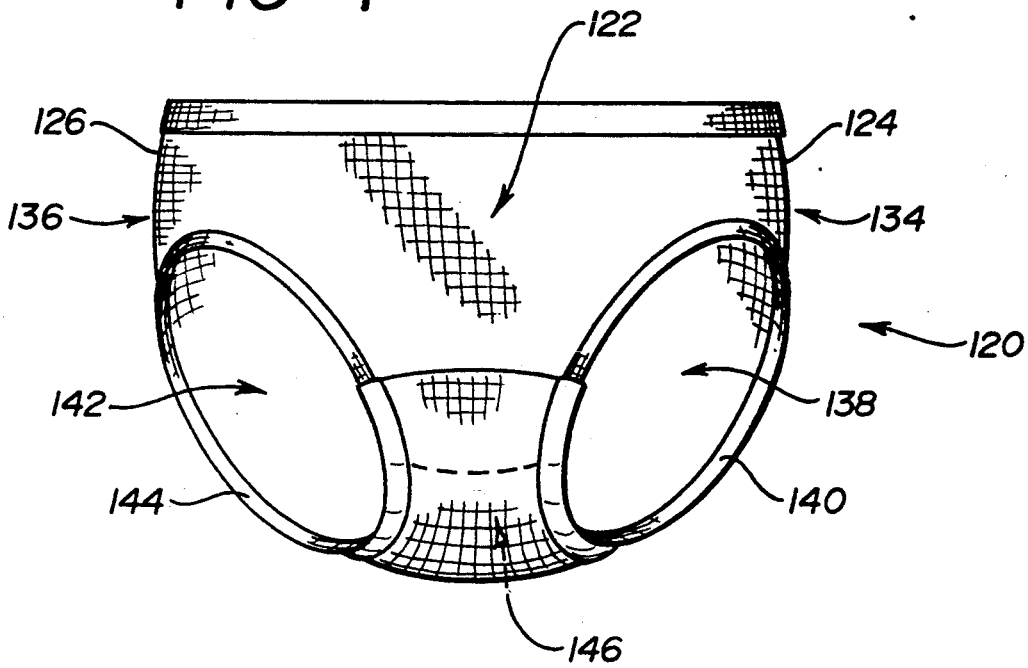
FIG. 4 illustrates a front view of another embodiment of the present invention where the undergarment is a pair of brief style underpants.

FIG. 1 is an exploded view of one embodiment of an undergarment 10 of the present invention. The undergarment 10 is a pair of bikini style underpants and has a waist band 12. The waist band 12 encircles the waist or hips of the wearer. A front panel 14 and a rear panel 16 attach to the waist band 12 and provide a crotch opening 18 therebetween. The rear panel 16, having a width w, and the waist band 12 form a back region 20. The width w of the rear panel 16 can vary and in the limit be reduced to zero, in which case the back region 20 becomes a rear section of the waist band 12. The front panel 14 and the back region 20 have attached thereto a left strap 22 and a right strap 24. The left strap 22 and the right strap 24 are spaced apart and span the crotch opening 18.

A crotch panel 26 has a left casing 28 and a right casing 30. The crotch panel 26 has a front edge 32, and the front panel 14 has a lower edge 34 which attaches to the front edge 32 of the crotch panel 26. The crotch panel 26 has a crotch panel free edge 36. The left casing 28 slidably engages the left strap 22 and the right casing 30 slidably engages the right strap 24. When the casings 28 and 30 substantially cover the straps 22 and 24 the crotch panel 26 covers the crotch opening 18. When the crotch opening 18 is covered by the crotch panel 26 the wearer can grasp the free edge 36 of the crotch panel 26 and pull the crotch panel 26 forward toward the front panel 14 uncovering the crotch opening 18. As the crotch panel 26 is pulled forward toward the front panel 14 the left casing 28 and the right casing 30 slide along the left strap 22 and the right strap 24 and the crotch panel 26 gathers into folds. The straps 22 and 24 aid in holding the gathered crotch in place when the crotch panel 26 is in the open position. Preferably the left strap 22 and the right strap 24 are flat and the width is only slightly smaller than the width of the opening of the casings 28 and 30. Having the casing 28 and 30 and the straps 22 and 24 so sized helps prevent the straps 22 and 24 from twisting in the casings 28 and 30. It is further preferred that the straps 22 and 24 are made of an elastic material. The elasticity of the straps 22 and 24 helps maintain the crotch panel 26 in close proximity with the body when the crotch panel 26 is in the closed position. It is further preferred that the crotch panel 26 is a two way stretchable material such as Lycra® spandex, which will further help maintain the crotch panel 26 in close proximity to the body when the crotch panel 26 is in the closed position.

It is also preferred that means for securing the crotch panel 26 over the back region element 20 be provided. One preferred means is to place an elastic strip 38 across the crotch panel 26 in close proximity to the free edge 36 of the crotch panel 26. This elastic strip 38 attaches to the left casing 28 and to the right casing 30. The elastic strip 38 provides a lateral pressure on the straps 22 and 24 which serves as the means for securing the crotch panel 26 over the back region element 20.

FIG. 2 is a rear view of another embodiment of the undergarment 50 of the present invention. The undergarment 50 is a pair of bikini style underpants with the back region 52 comprising a waist band 54 and a rear panel 56 which extends substantially below the waist band 54. The left strap 58 and the right strap 60 are attached to the rear panel 56 and the front panel 62. The left casing 64 and the right casing 66 engage the left strap 58 and the right strap 60 respectively. In this embodiment the means for securing the crotch panel 68 over the back region 52 is a hook and pile fastener 70, such as a Velcro® fastener, located near the crotch opening 72. It is also preferred that the straps 58 and 60 are attached in close proximity to the crotch opening 72 to minimize the sliding of the crotch panel 68 over the rear panel 56 thus reducing the adjustment of the rear panel 56 required after sliding the crotch panel 68 to its closed position.

FIG. 3 illustrates a rear view of another embodiment of the undergarment 80 of the present invention. In this embodiment the width w of the rear panel 16 of FIG. 1 is reduced to zero and the back region 20 is reduced to a rear section 82 of the waist band 84. The crotch panel 86 for the embodiment of FIG. 3 is an integral part of the front panel 88. With this configuration, a left casing 90 and a right casing 92 bound the front panel 88 as well as the crotch panel 86. The crotch panel 86 is held in position over the rear section 82 of the waist band 84 with securing means. Snaps 94 are employed as securing means since snaps on the waist band 84 will not result in discomfort to the wearer when the wearer is seated.

When the casings 90 and 92 bound both the front panel 88 and the crotch panel 86 a left strap 96 and a right strap 98 attach to a front section 100 of the waist band 84 and to the rear section 82 of the waist band 84. These connections being preferably made at a lower edge 102 of the waist band 84. When the straps 96 and 98 are so attached it is preferred that the left casing 90 and the right casing 92 terminate before the free edge 104 of the crotch panel 86 to provide overlap of the crotch panel 86 with the waist band 84.

While it is preferred that the crotch panel 86 be attached to the front section 100 of the waist band 84 for ease of opening and closing by the wearer, it should be appreciated that the crotch panel 86 could be attached to the rear section 82 of the waist band 84.

Figure 5:
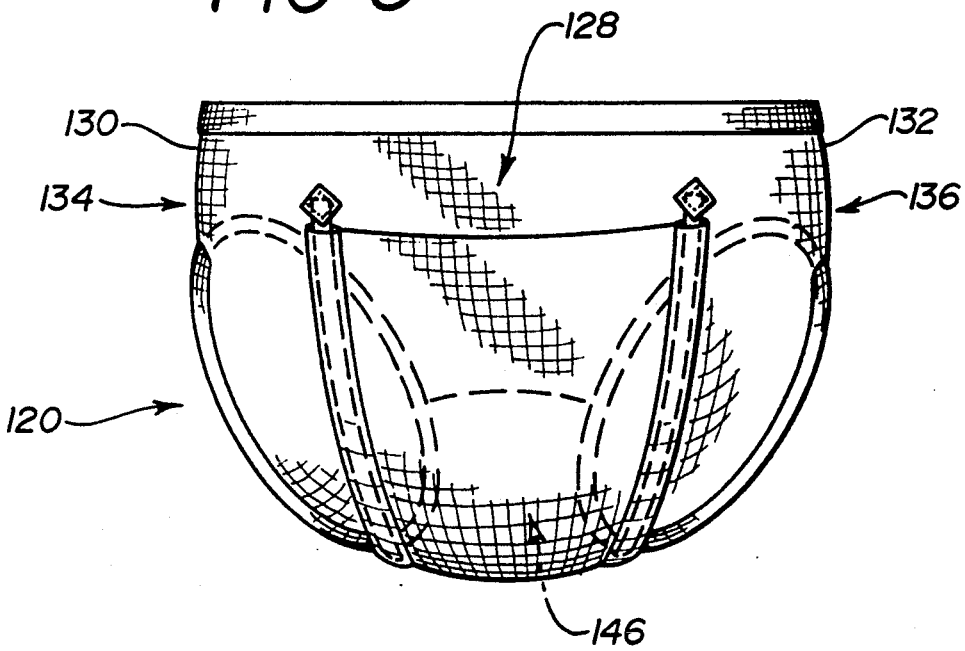
FIG. 5 shows a rear view of the pair of brief style underpants of the embodiment of the undergarment of FIG. 4.

FIG. 4 and FIG. 5 are respectively a front view and a rear view of another embodiment of an undergarment 120 of the present invention. The undergarment 120 is a pair of brief style underpants. FIG. 4 is a front view of the undergarment 120 showing a front panel 122 having a left front panel edge 124 and a right front panel edge 126. FIG. 5 shows a rear panel 128 of the undergarment 120 having a left rear panel edge 130 and a right rear panel edge 132. The left front panel edge 124 and the left rear panel edge 130 join to form a left side 134 of the undergarment 120. The right front panel edge 126 and the right rear panel edge 132 join to form a right side 136 of the undergarment 120.

Referring again to FIG. 4, the left side 134 has a left cutout section 138 which is bound by a left leg band 140. The right side 136 has a right cutout section 142 which is bound by a right leg band 144. Preferably the left leg band 140 and the right leg band 144 are elastic.

Figure 6:
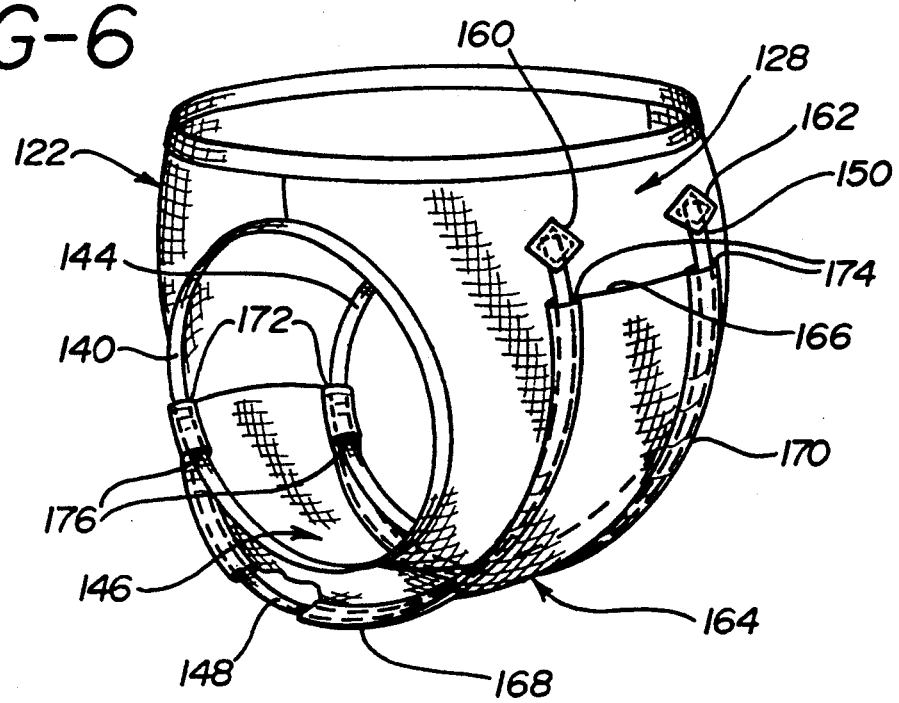
FIG. 6 is a side perspective view of the embodiment of the undergarment of FIG. 4 and FIG. 5.

FIG. 6 is a side perspective view of the embodiment of the undergarment of FIG. 4 and FIG. 5. It illustrates a crotch opening 146 between the front panel 122 and the rear panel 128 which is bound by the left leg band 140 and the right leg band 144. Also shown is a left strap 148 attached to the front panel 122 at the left leg band 140 and to the rear panel 128. A right strap 150 is attached to the front panel 122 at the right leg band 144 and to the rear panel 128. Preferably reinforcing elements 160 and 162 are sewn to the straps 148 and 150 and to the back panel 128 to provide additional support for the spaced apart right strap 150 and left strap 148. A crotch panel 164 attaches to the front panel 122 and has a crotch panel free end 166. The crotch panel 164 has a left casing 168 which engages the left strap 148 and a right casing 170 which engages the right strap 150. As shown in FIG. 6, the crotch panel 164 covers the crotch opening 146 and substantially overlaps the rear panel 128. This overlap results in a substantial frictional force between the rear panel 128 and the crotch panel 164 and provides means for securing the crotch panel 164 over the rear panel 128. It is preferred that the overlap is at least 50% of the rear panel 128.

FIG. 6 also illustrates the spacial relationship between the casings 168 and 170 of the crotch panel 164, the leg bands 140 and 144, and the straps 148 and 150. The casings 168 and 170 have front entrances 172 and rear exits 174, as well as intermediate exits 176. The straps 148 and 150 pass through the casings 168 and 170 from the front entrances 172 to the rear exits 174. The leg bands 140 and 144 pass through the casings 168 and 170 entering at the front entrances 172 and exiting at the intermediate exits 176.

Figure 7:
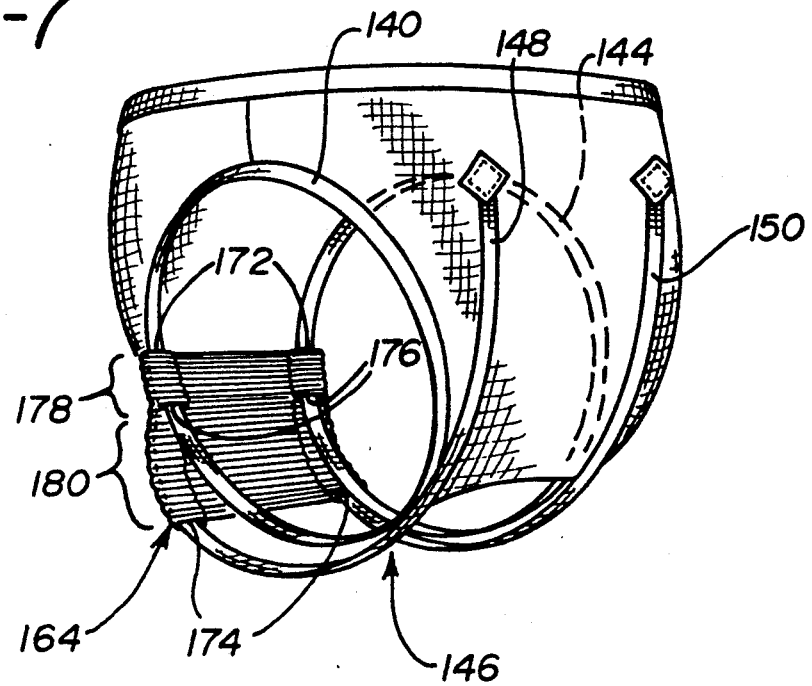
FIG. 7 is a side view similar to FIG. 6, however the crotch panel is gathered into folds and is in close proximity with the front panel.

FIG. 7 is a perspective view of the undergarment of FIG. 6 with the crotch panel 164 pulled forward leaving the crotch opening 146 uncovered. With the crotch panel 164 pulled forward it gathers into folds about the straps 148 and 150 as well as about the leg bands 140 and 144. A first section 178 of the crotch panel 164, which is bound by the front entrances 172 of the casing and the intermediate casing exits 176, gathers into folds about the straps 148 and 150 as well as about the leg bands 140 and 144. A second section 180 of the crotch panel 164, which is bounded by the intermediate exits 176 and the rear exits 174, gathers into folds about only the straps 148 and 150.

Figure 8:
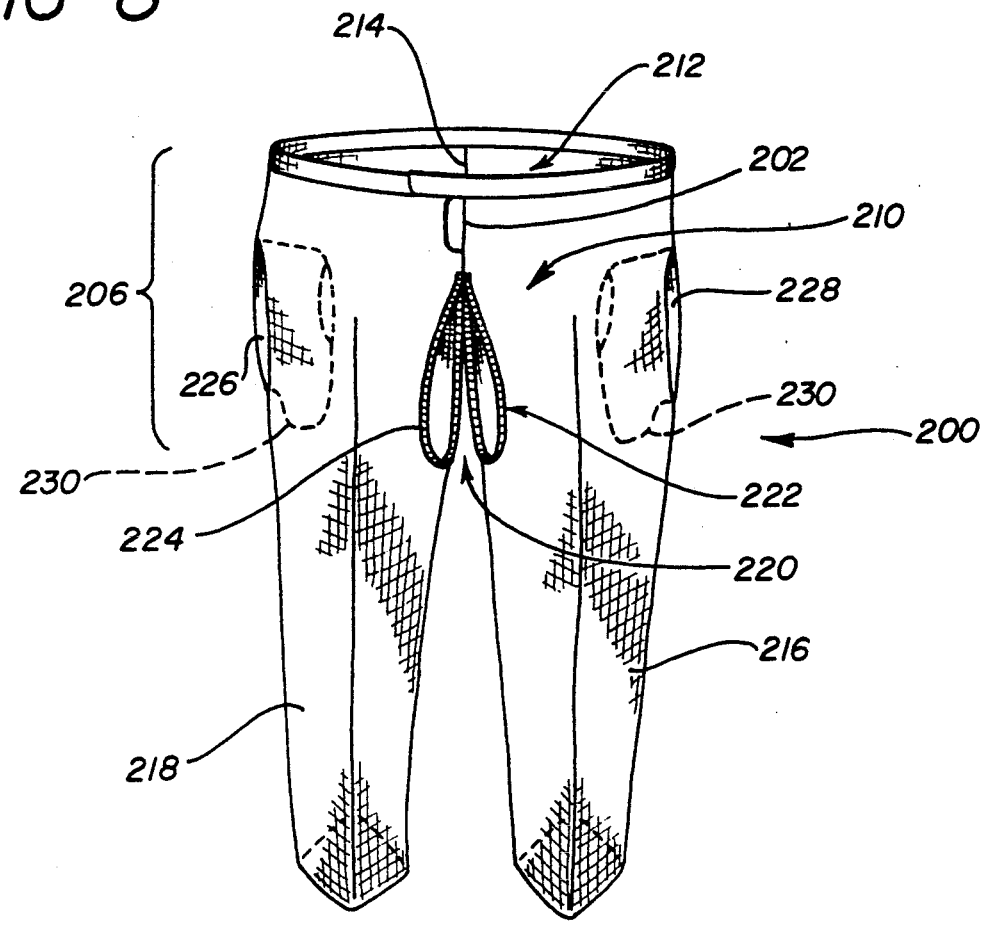
FIG. 8 is an embodiment of the bifurcated overgarment of the present invention which is a front opening pair of pants.

FIG. 8 illustrates a bifurcated overgarment of the present invention which is preferably used in combination with the undergarment of the present invention such as described above and illustrated in FIGS. 1-7. The overgarment is a pair of slacks 200 which have a front vent 202 making it easier to don the slacks 200. An elastic waist band offers an alternative to the vent to facilitate donning slacks. The garment has a trunk element 206 which covers the lower portion of the torso. The trunk element 206 has a front side 210 and a back side 212. A center seam 214 passes from the back side 212 to the front side 210. A left leg element 216 and a right leg element 218 attach to the trunk element 206. The three elements meet to form a crotch 220.

The crotch is provided with a closable elongated opening 222 which lies in the center seam 214. It is preferred that the elongated opening 222 be substantially centered about the crotch 220. It is further preferred that the elongated opening 222 be at least about 14 inches long.

It is still further preferred that the closure means for the elongated opening 222 be a soft zipper 224 such as a polyester or nylon zipper, and that the zipper is so positioned that in the closed position the zipper tab is in the front. This position is preferred for comfort and ensures that the zipper tab will not interfere with sitting.

When a belted pair of pants is employed or when non-elastic waist bands are employed, a right access opening 226 and a left access opening 228 are preferred to allow the wearer to place her hands under the slacks 200 for adjustment of an undergarment. These access openings 226 and 228 can be used to provide access to pockets 230 as well as to provide access to the undergarment.

When a front vent 202 is employed the front vent 202 forms an extension of the elongated opening 222. While the vent 202 and the elongated opening 222 form continuous paths, they have separate closing means so that either can be opened or closed separately. Maintaining the front vent 202 closed aids in the opening of the elongated opening 222 when the legs of the wearer are separated by maintaining pressure on the outer sides of the leg elements by the thighs of the wearer.

Figure 9:
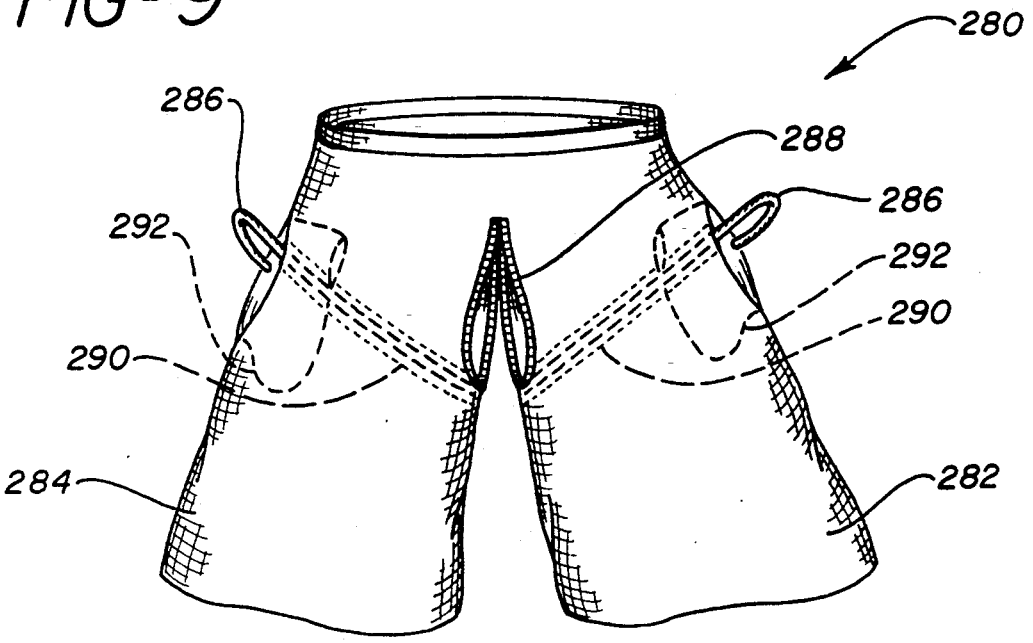
FIG. 9 illustrates another embodiment of the bifurcated overgarment of the present invention. In this embodiment the leg elements are wide such in as a pair of culottes. Drawstrings are provided for gathering the material to reduce the effective cross section area of the leg elements.

FIG. 9 illustrates another embodiment of an overgarment of the present invention. In this embodiment the crotch related elements of the present invention are contained in a pair of culottes 280. The culottes 280 have an oversized left leg element 282 and an oversized right leg element 284. With the oversized leg elements 282 and 284, the thighs of the wearer will not maintain pressure on the outer sides of the leg elements. In such cases it is preferred that draw strings 286 attach to the elongated slot 288 in close proximity to its lowest point. The drawstrings 286 are carried in guide passages 290 that open to the side of the garment in the thigh region. The opening can be in pockets 292. Having the drawstrings 286 so positioned allows them to be stored out-of-sight in the pockets 292.

Figure 10:
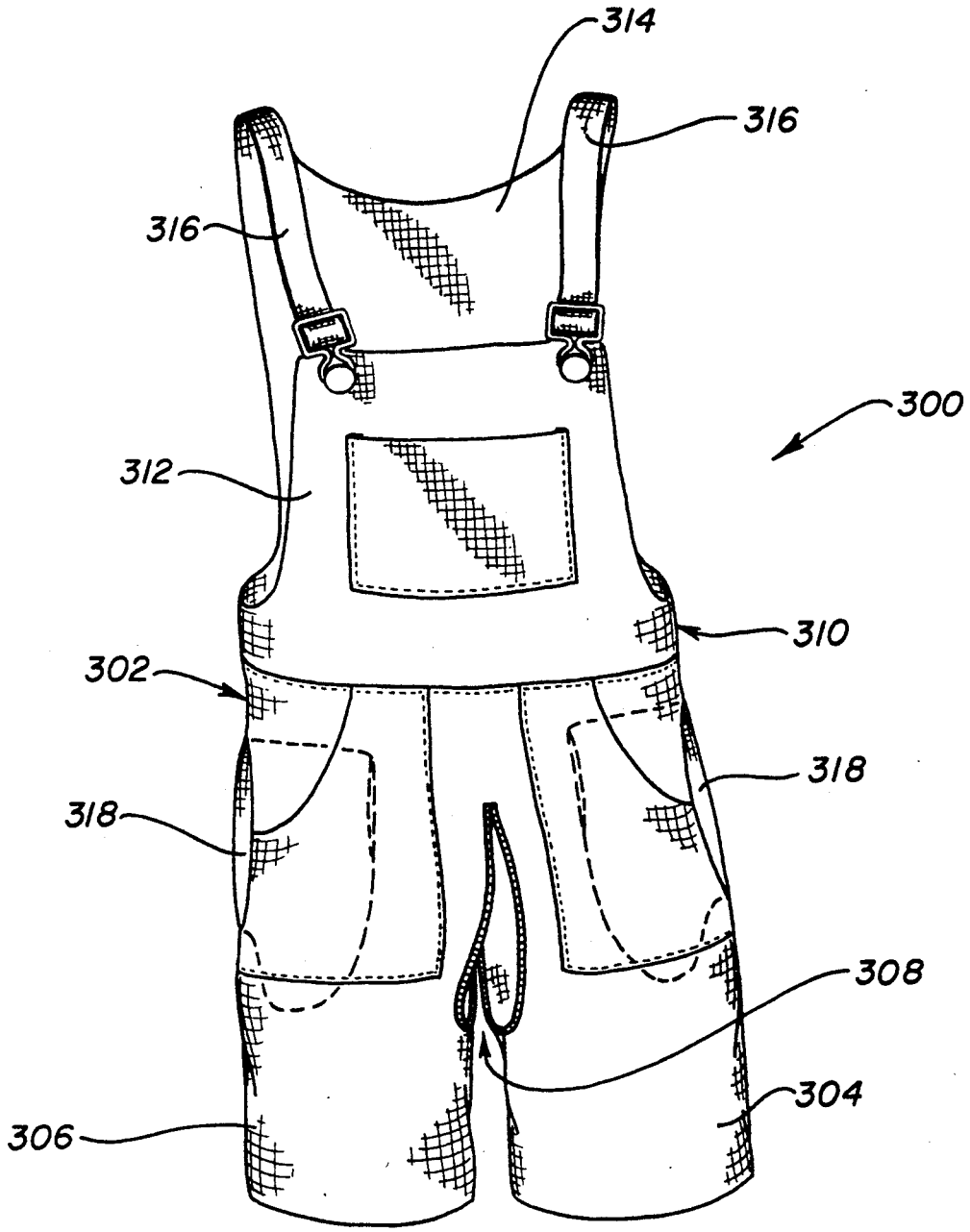
FIG. 10 illustrates one embodiment of a bifurcated one piece pull on overgarment of the present invention.

FIG. 10 is a bibbed bifurcated overgarment 300. In this garment and similar one piece garments such as jump suits and one piece ski outer wear the crotch related elements of the present invention have particular utility since, without such elements, substantial disrobing is required for the use of toilet facilities.

The bibbed overgarment 300 has a trunk element 302, a left leg element 304 and a right leg element 306. The three elements again meet to form a crotch 308. This garment differs from the other overgarments previously described in that the earlier described embodiments were supported by the waist and hips of the wearer. In the embodiment of FIG. 10 the bifurcated overgarment is supported by an upper body member 310 which attaches to the trunk element 302. In the embodiment shown in FIG. 10, the upper body member has a front bib 312, and a back bib 314, with shoulder straps 316 attached therebetween.

In the case of the bibbed overgarment 300 and other one piece overgarments hand access openings 318 are highly preferred in order to allow adjustment of an undergarment. This strong preference results from the fact that the waist does not provide an alternative means for adjusting the undergarment.

Figure 11:
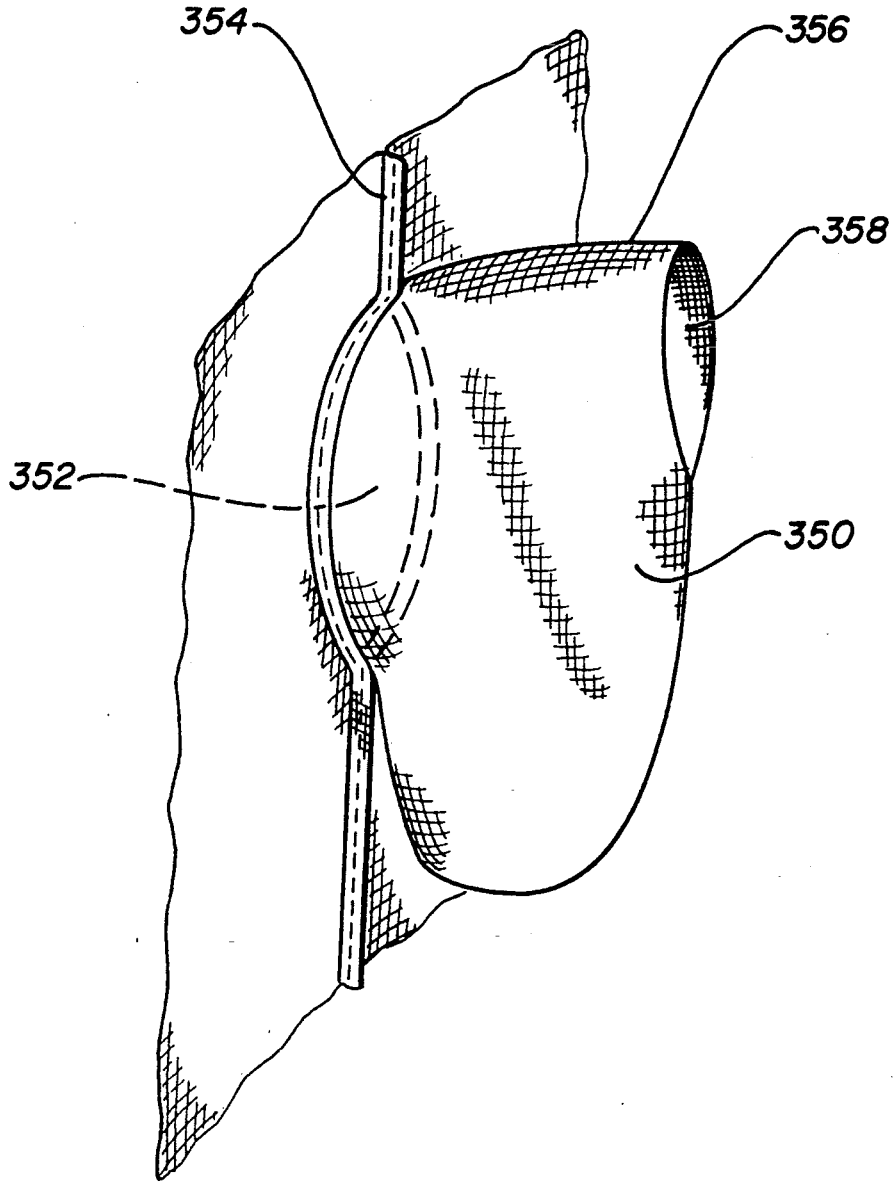
FIG. 11 is a figure of the side pocket region of FIG. 11 with the pocket sections viewed from within the garment.

FIG. 11 shows an inside view of a side pocket lining 350 which employs a hand access opening 352. The lining 350 is configured to provide access to the undergarment. The side pocket lining 350 is sewn into a section of a side seam 354 of an overgarment. The top edge 356 of the pocket 350 is not attached to the overgarment, thus allowing the pocket lining 350 to freely move within the overgarment. The pocket lining 350 has a hand pass through opening 358 which permits the hand to pass through the pocket so as to allow adjustment of the undergarment.

As an alternative, the hand access openings may be located in the rear of the overgarment. When located in the rear they may be concealed in hip pockets and contain similar hand pass through openings.

It will be apparent that there will be many variations which can be made from the precise structural details described above with regard to the particular embodiments discussed without departing from the scope of the claims which follow.

What I claim is:

1. An undergarment comprising:

a waist band having a front section and a rear section;

a front panel attached to said front section of said waist band;

a rear panel attached to said rear section of said waist band, said rear panel and said rear section of said waist band forming a back region, said front panel and said back region being so positioned to provide a crotch opening therebetween;

a right strap spanning said crotch opening attaching to said front panel and said back region;

a left strap spaced apart from said right strap, said left strap spanning said crotch opening and attaching to said front panel and said back region; and a crotch panel attached to said front panel, said crotch panel having a left casing and a right casing attaching thereto, said left casing slidably engaging said left strap, said right panel slidably engaging said right strap thereby providing a slidable crotch panel such that the crotch opening can be covered and uncovered.

2. The undergarment of claim 1 further comprising:

means for securing said crotch panel over said rear panel.

3. The undergarment of claim 2 wherein said left strap and said right strap are elastic.

4. The undergarment of claim 3 wherein said crotch panel has a free edge, and further wherein said crotch panel has an elastic element in close proximity to said free edge and connected to said left casing and said right casing therein, said elastic element serving as said means for securing said crotch panel over said rear panel.

5. The undergarment of claim 3 wherein said means for securing said crotch panel over said rear panel are fasteners, said fasteners being selected from the group of fasteners consisting of hook and pile, snaps, and eye and hook.

6. The undergarment of claim 3 wherein:

said front panel has a left front panel edge and a right front panel edge and said rear panel has a left rear panel edge and a right rear panel edge, said left edge of said front panel attaching to said left edge of said rear panel forming a left side and said right edge of said front panel attaching to said right edge of said rear panel forming a right side;

said left side has a left cutout section bounded by a left leg band, and said right side has a right cutout section bounded by a right leg band; and said left strap attaches to said front panel at said left leg band, and said right strap attaches to said front panel at said right leg band.

7. The undergarment of claim 6 wherein said left leg band and said right leg band are elastic.

8. The undergarment of claim 7 wherein said crotch panel which when fully engaging said right strap and said left strap substantially overlap said rear panel thereby providing said means for securing said crotch panel over said rear panel.

9. An undergarment comprising:

a waist band having a front section and a rear section;

a front panel attached to said front section of said waist band;

a right strap attaching to said front panel and to said rear section of the waist band;

a left strap spaced apart from said right strap, said left strap attaching to said front panel and to said rear section of said waist band; and a crotch panel attached to said front panel, said crotch panel having a left casing and a right casing attaching thereto, said left casing slidably engages said left strap, said right casing slidably engages said right strap.

10. The undergarment of claim 9 further comprising: means for securing said crotch panel to said rear section of said waist band.

11. The undergarment of claim 10 wherein said left strap and said right strap are elastic.

12. The undergarment of claim 11 wherein said crotch panel has a free edge having an elastic element in close proximity to said free edge and connected to said left casing and said right casing, said elastic element serving as means for securing said crotch panel over said rear section of said waist band.

13. The undergarment of claim 11 wherein said means for securing said crotch panel over said rear section of said waist band are fasteners, said fasteners being selected from the group of fasteners comprised of hook and pile, snaps, and eye and hook.

14. An undergarment comprising:

a waist band having a front section and a back section;

a front panel attached to said front section of said waist band;

a right strap attached to said front section of said waist band and to said rear section of said waist band;

a left strap spaced apart from said right strap, said left strap attached to said front section of said waist band and to said rear section of said waist band;

a crotch panel attaching to said front panel and forming an integral part thereof;

a left casing attached to said front panel and said crotch panel, said left casing slidably engages said left strap; and a right casing attached to said front panel and said crotch panel, said right casing slidably engages said right strap.

15. The undergarment of claim 14 wherein said left strap and said right strap are elastic and further comprising means for securing said crotch panel over said rear section of said waist band.

16. The undergarment of claim 15 wherein said crotch panel has a free edge having an elastic element in close proximity to said free edge and connected to said left casing and said right casing, said elastic element serving as said means for securing said crotch panel over said rear section of said waist band.

17. The undergarment of claim 15 wherein said means for securing said crotch panel over said rear section of said waist band are fasteners, said fasteners being selected from the group of fasteners comprised of hook and pile, snaps, and eye and hook fasteners.

18. Underpants comprising:

a waist band having a front section and a rear section;

a front panel attached to said front section of said waist band;

a rear panel attached to said rear section of said waist band, said rear panel and said rear section of said waist band forming a back region, said front panel and said back panel being so positioned to provide a crotch opening therebetween;

a right strap attached to said front panel and said back region;

a left strap attached to said front panel and said back region;

a left side having a left cutout section which is bound by a left leg band;

a right side having a right cutout section which is bounded by a right leg band;

said crotch opening being further bounded by said left side and said right; and a crotch panel attached to said front panel, said crotch panel having a left casing and a right casing slidably engaging said left strap, and said right panel slidably engaging said right strap.

19. The underpants of claim 18 further comprising: means for securing said crotch panel over said rear panel.

20. The underpants of claim 19 wherein said crotch panel which when fully engaging said right strap and said left strap substantially overlaps said rear panel thereby providing said means for securing said crotch panel over said rear panel.

21. The underpants of claim 20 wherein said left strap attaches to said front panel at the left leg band and said right strap attaches to said front panel at said right leg band.

22. The underpants of claim 21 wherein said left strap, said right strap, said left leg band, and said right leg band are elastic.

23. The underpants of claim 22 wherein said left casing and said right casing each have a front entrance, and a rear exit, and an intermediate exit and further wherein said leg bands pass through first entrance and said intermediate exit while said straps pass through said casing entrance and said rear exit.

24. An overgarment and underpants combination comprising:

a waist band having a front section and a rear section;

a front panel attached to said front section of said waist band;

a rear panel attached to said rear section of said waist band, said rear panel and said rear section of said waist band forming a back region, said front panel and said back panel being so positioned to provide a crotch opening therebetween;

a right strap attached to said front panel and said back region;

a left strap attached to said front panel and said back region;

a left side having a left cutout section which is bound by a left leg band;

a right side having a right cutout section which is bounded by a right leg band;

said crotch opening being further bounded by said left side and said right;

a crotch panel attached to said front panel, said crotch panel having a left casing and a right casing slidably engaging said left strap, and said right panel slidably engaging said right strap;

a trunk element having a front and back with a seam passing from said front to said back, said trunk element enclosing said waist band, said front panel, said back panel, said crotch panel, said left side and said right side;

a left leg element joining said trunk element;

a right leg element joining said trunk element, said left leg, said right leg, and said trunk element being so joined as to form a crotch; and a closable elongated opening centered with respect to and passing through said crotch, said elongated opening lying in said center seam.

25. The overgarment and underpants combination of claim 24 further comprising:

hand openings to provide access to said crotch panel for adjusting of the crotch panel of the underpants.

26. The overgarment and underpants combination of claim 25 wherein said hand openings are side openings.

27. The overgarment and underpants combination of claim 26 wherein said elongated opening is at least 12 inches.

28. The overgarment and underpants combination of claim 27 further comprising:

a zipper to secure said elongated opening in a closed position.

* * * * *